United States Patent [19]

Turk et al.

[11] Patent Number: 4,561,244

[45] Date of Patent: Dec. 31, 1985

[54] METHOD AND APPARATUS FOR SPINNING YARN AND RESULTING YARN PRODUCT

[75] Inventors: Herbert Turk, Remscheid; Herbert Schiminski, Hückeswagen, both of Fed. Rep. of Germany

[73] Assignee: Barmag Barmer Maschinenfabrik AG, Remscheid, Fed. Rep. of Germany

[21] Appl. No.: 552,740

[22] Filed: Nov. 17, 1983

[30] Foreign Application Priority Data

Nov. 19, 1982 [DE] Fed. Rep. of Germany ..... 3242718
Nov. 26, 1982 [DE] Fed. Rep. of Germany ..... 3243844

[51] Int. Cl.[4] ..... D01H 7/92; D01H 13/04; D02G 3/38; B65H 57/28

[52] U.S. Cl. ..... 57/336; 57/340; 57/352

[58] Field of Search ..... 57/224, 336, 339, 340, 57/328, 352, 334, 332

[56] References Cited

U.S. PATENT DOCUMENTS

| | | | |
|---|---|---|---|
| 3,001,358 | 9/1961 | Mayner | 57/244 X |
| 3,955,350 | 5/1976 | Schuster | 57/340 X |
| 4,003,194 | 1/1977 | Yamagata et al. | 57/328 |
| 4,142,354 | 3/1979 | Nakahara | 57/350 X |
| 4,183,202 | 1/1980 | Morihashi | 57/351 X |
| 4,339,915 | 7/1982 | Dammann et al. | 57/340 X |
| 4,377,932 | 3/1983 | Dammann et al. | 57/336 |
| 4,383,405 | 5/1983 | Bauer et al. | 57/348 X |
| 4,399,648 | 8/1983 | Kato | 57/328 X |
| 4,408,449 | 10/1983 | Bauer et al. | 57/340 |
| 4,434,611 | 3/1984 | Hasegawa et al. | 57/328 |

OTHER PUBLICATIONS

Textile World, Oct. 1973, pp. 41–42 "Recent Developments in Spinning" by Dr. Anastas Lazaridis.

*Primary Examiner*—Donald Watkins
*Assistant Examiner*—Joseph J. Hail, III
*Attorney, Agent, or Firm*—Bell, Seltzer, Park & Gibson

[57] ABSTRACT

A method and apparatus is disclosed for producing a spun yarn composed of an inner substantially untwisted core having fibers spirally wrapped about the surface thereof. In a specifically illustrated embodiment, a yarn of staple fibers is advanced along a path of travel, while being laterally deflected by contact with each of three separate rotating discs, and so as to produce a rotating balloon which serves to open the yarn and loosen and separate fibers on the surface of the yarn. Subsequently, the advancing yarn is subjected to a false twisting operation, which serves to wrap the loosened fibers about the advancing yarn.

29 Claims, 11 Drawing Figures

METHOD AND APPARATUS FOR SPINNING YARN AND RESULTING YARN PRODUCT

The present invention relates to a method and apparatus for producing a spun yarn composed of substantially untwisted core fibers which are held together by spirally wrapped fibers on the outside surface.

It has heretofore been proposed to produce a directly spun yarn by deflecting an advancing sliver of staple fibers so as to separate free ends of the fibers from the body of the yarn, and to then twist or wrap these free ends about the untwisted core. As a specific example, there is disclosed in prior U.S. Pat: Nos. 4,142,354 and 4,183,202 a spinning method which comprises two successive nozzles, with the first nozzle adapted to impart rotation to an advancing yarn to cause ballooning in one direction, and with the second nozzle adapted to impart false twist in the opposite direction. A similar spinning method is disclosed on pages 40–42 of Textile World, October, 1973.

The present invention is based upon the recognition that the method of producing spun yarn directly from sliver can be carried out more reliably, and at greater speeds, by increasing the numbers of individual fibers or fiber ends which are loosened and separated from the surface of the twisted structure produced by the false twisting operation. It is accordingly an object of the present invention to exert substantially greater dynamic forces on the yarn structure in the false twist zone than can be generated by the known pneumatic systems.

It is a further object of the present invention to provide a highly reliable and effective system for imparting false twist to an advancing yarn in a spinning operation of the described type.

These and other objects and advantages of the present invention are achieved in the present invention by the provision of a yarn spinning method and apparatus wherein the yarn is physically contacted by a moving guide member so as to oscillate the advancing yarn in two dimensions transverse to its advancing direction and so as to cause fibers to be loosened on the surface of the yarn. In a preferred embodiment, the yarn is brought to a ballooning movement by a rotating, or a linearly movable guide member. The guide member may comprise any construction which is adapted to apply to the yarn an oscillating, rotating, or linear movement transversely to its advancing direction. In this regard, it should be noted that a linearly movable guide member can impart a ballooning movement to the yarn, though it may not be uniform by reason of interfering factors, such as for example, irregularities of the fiber bundle, which are usually present.

In one simple embodiment, the guide member can be a rotating disc with an effectively non-circular periphery, with the moving periphery being adapted to contact the yarn. The disc may for example be circular, and mounted in an eccentric manner. In another embodiment, the disc includes an arcuately curved periphery, and since very high ballooning frequencies are required, it is preferred that the curvature include several eccentricities over its circumference, so that the transmission ratio of the disc rotational speed and the balloon rotational speed is such as to permit a relatively low disc rotational speed and a high ballooning frequency.

In a further embodiment, the guide member may comprise a disc which rotates about an axis which is parallel to the advancing direction of the yarn, with the disc being inclined relative to its axis, so that the distance between the axis and the yarn varies upon rotation of the disc in an elliptical manner.

In the case of a unitary guide member, the ballooning speed depends not only on the frequency of the guide member, but also upon the yarn tension. To avoid this dependence, the guide member may consist of two and preferably three discs, which are mounted on parallel axes and overlap, and so that the adjacent peripheral portions collectively define a yarn guide passage which moves according to a predetermined path of motion as the discs are rotated. For example, the defined yarn guide passage may move linearly, along a generally circular path, or along a polygonal path with rounded corners, when viewed in a plane transverse to the direction of the advancing yarn. The discs are driven at a constant relative speed, preferably at the same speed and in the same direction. Further, it is preferred to provide several eccentricities on the circumference of the discs, which causes the yarn to travel through several ballooning cycles during each rotation of the discs. It is also possible to design the discs so as to provide unique ballooning motions, which can produce high dynamic forces. This applies, for example, to motions which are irregular, and which include periods of rapid accelerations and decelerations.

The advantage of the above described deflecting guide member resides in the fact that the rotary direction of the balloon can be predetermined by the design of the phase displacement of the discs. This permits a twist effect to be imparted to the yarn in either the same or opposite direction, which effect is produced on the one hand by the friction of the yarn on the peripheral surface, and on the other hand by the ballooning of the yarn, so that a high twist or a low twist may be imparted, and so that the twist generated by the subsequent false twisting unit may be either increased or decreased.

The method and apparatus of the present invention further includes the step of wrapping the loosened fibers spirally about the body of the advancing yarn. This wrapping step includes a false twisting apparatus positioned downstream of the location at which the fibers are loosened. The false twisting apparatus preferably comprises a pair of false twisting members which are disposed to frictionally contact opposite sides of the advancing yarn, and so as to impart a transverse twisting force component as well as a force component in the advancing direction. In one preferred embodiment, the twisting members comprise a pair of circular discs which are mounted for rotation such that opposing faces thereof define a twisting zone therebetween through which the advancing yarn passes. Further, it is preferred that one of the discs be relatively thin and flexible, so that it may be engaged on its back side by disc impingement means so that it is biased toward the other disc locally at the twisting zone.

As a further embodiment of an advantageous friction false twisting unit, there may be provided a disc which is mounted in a gimbal-like manner relative to its mounting shaft, and which is preferably flexible so that its front face may be resiliently biased against the yarn, or an opposing surface. An apparatus of this general type is disclosed in German OS No. 31 23 671 and corresponding U.S. Pat. No. 4,408,449.

In another specific embodiment of the invention, the advancing yarn is guided through nip roll means disposed between the deflecting guide member and the false twisting apparatus. The nip roll means may comprise two driven rolls, which nip the yarn between them and thus prevent the twist imparted by the false twisting apparatus from returning upstream to the location of the yarn deflecting member.

Some of the objects and advantages of the invention having been stated, other will become apparent as the description proceeds, when taken in conjunction with the accompanying drawings, in which FIG. 1 is a schematic perspective view of a spinning apparatus which embodies the present invention;

Figure 1:
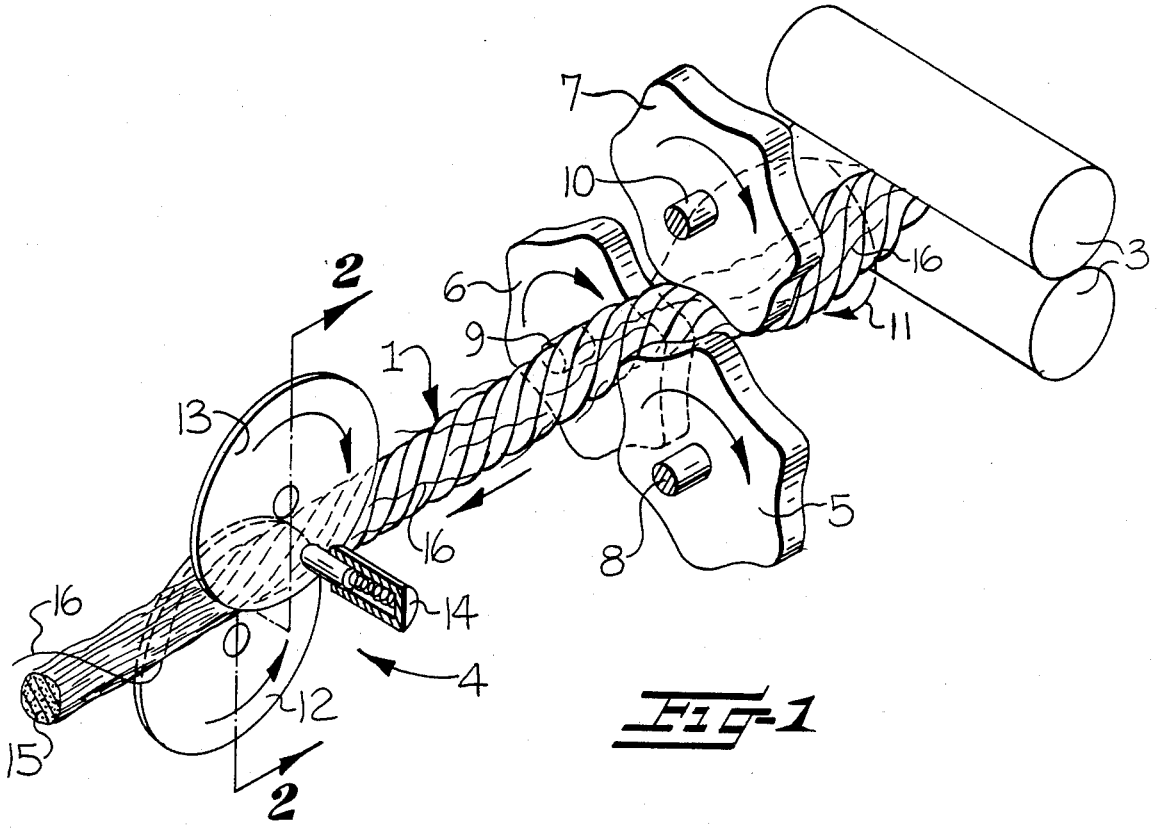
Figure 2:
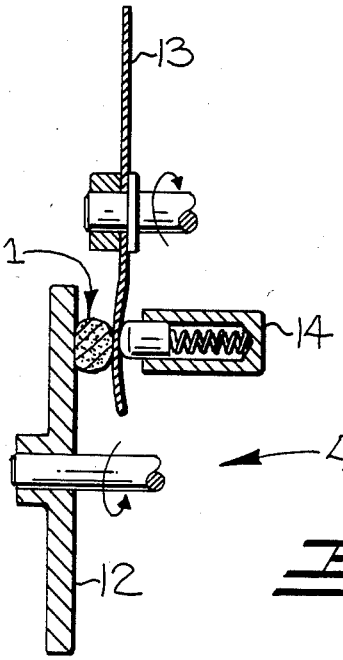
FIG. 2 is a sectional view of the twisting apparatus, and taken substantially along the line 2—2 of FIG. 1.
Figure 3:
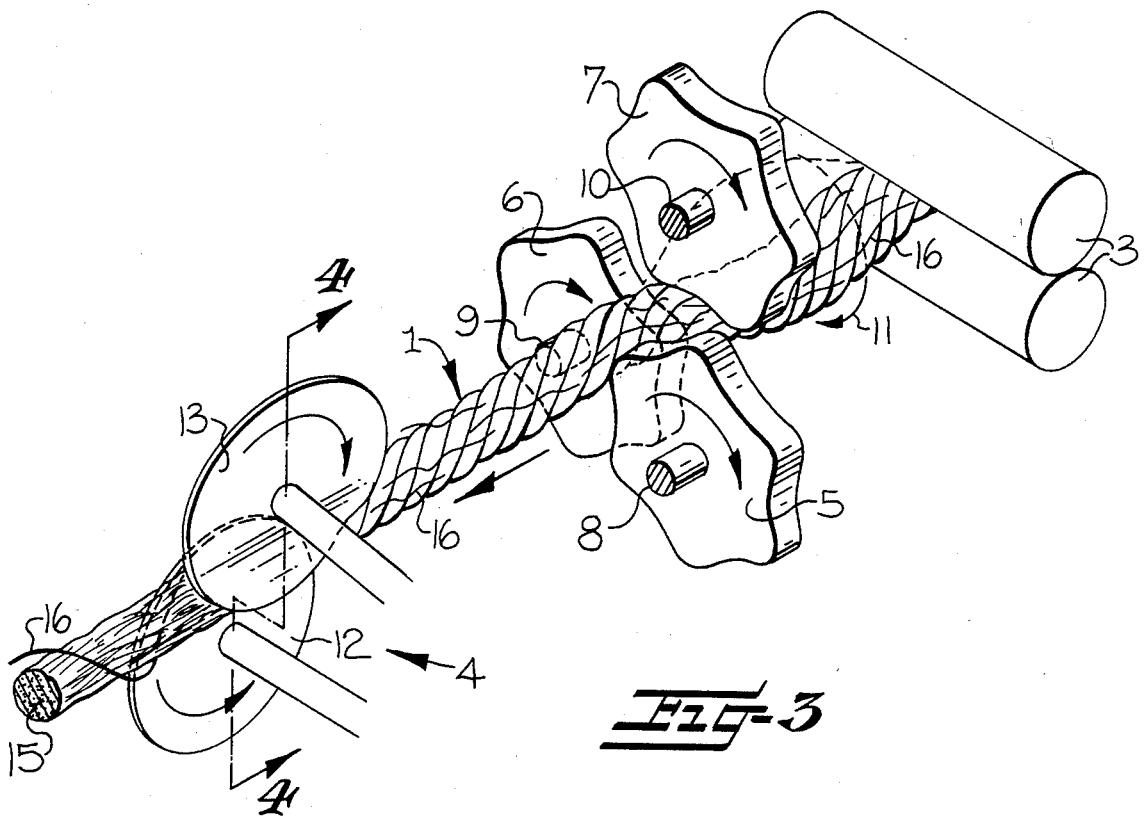
FIGS. 3 and 5 are views similar to FIG. 1, but illustrating other embodiments of the twisting apparatus.
Figure 4:
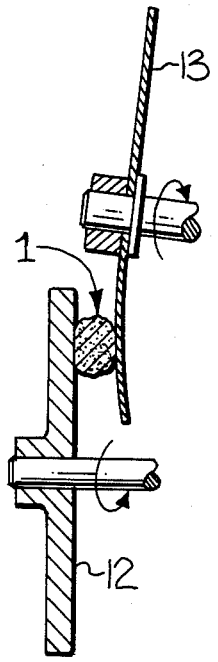
Figure 5:
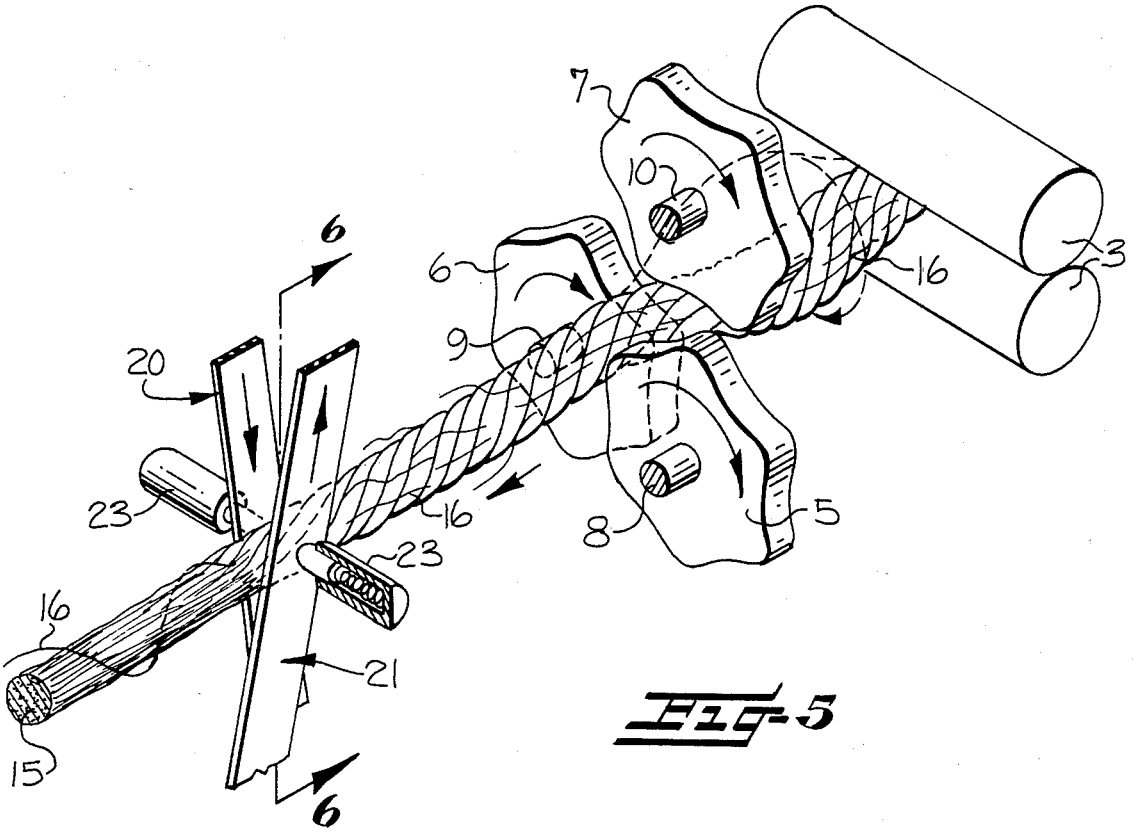
Figure 6:
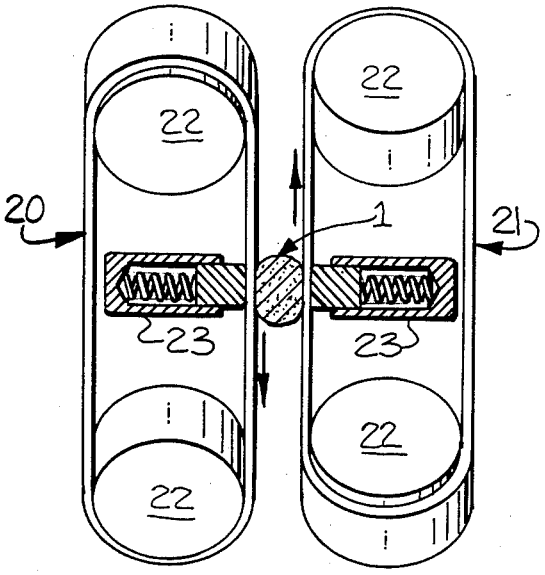
Figure 7:
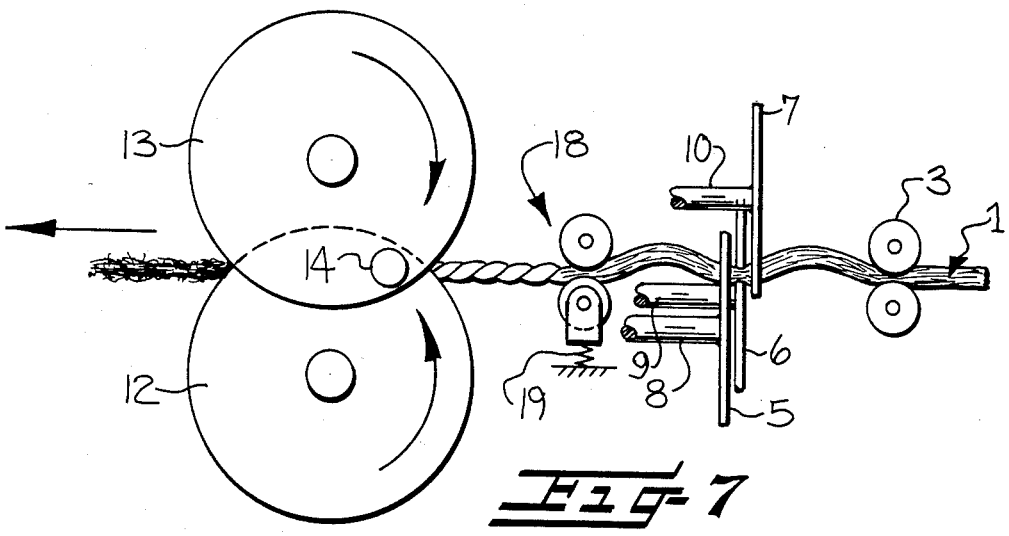
Figure 8:
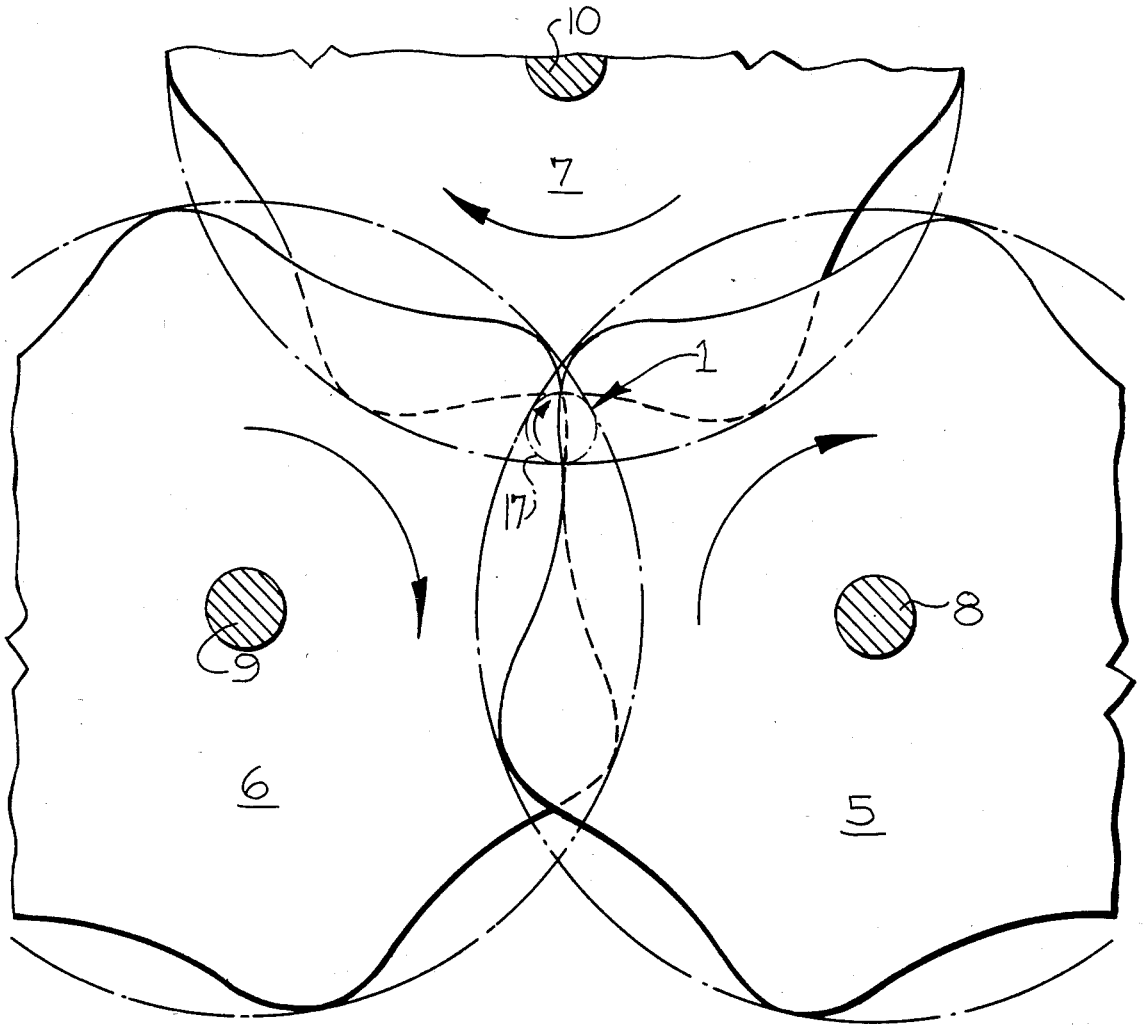
Figure 8A:
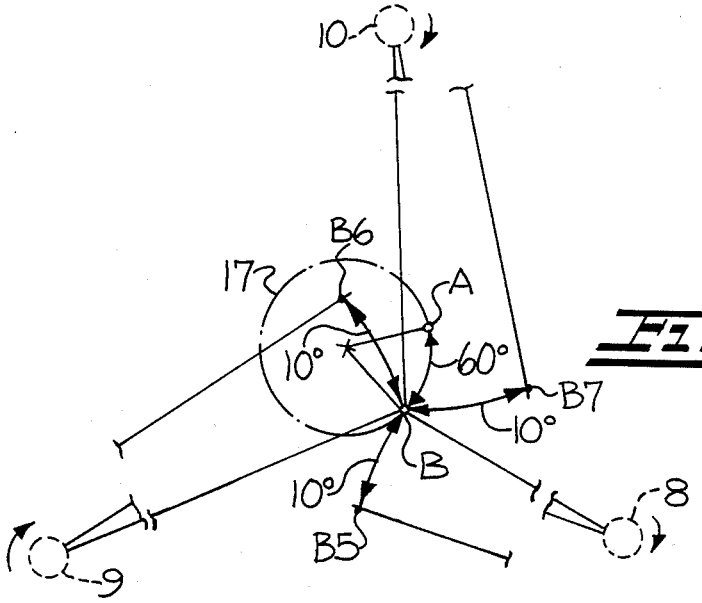
Figure 9:
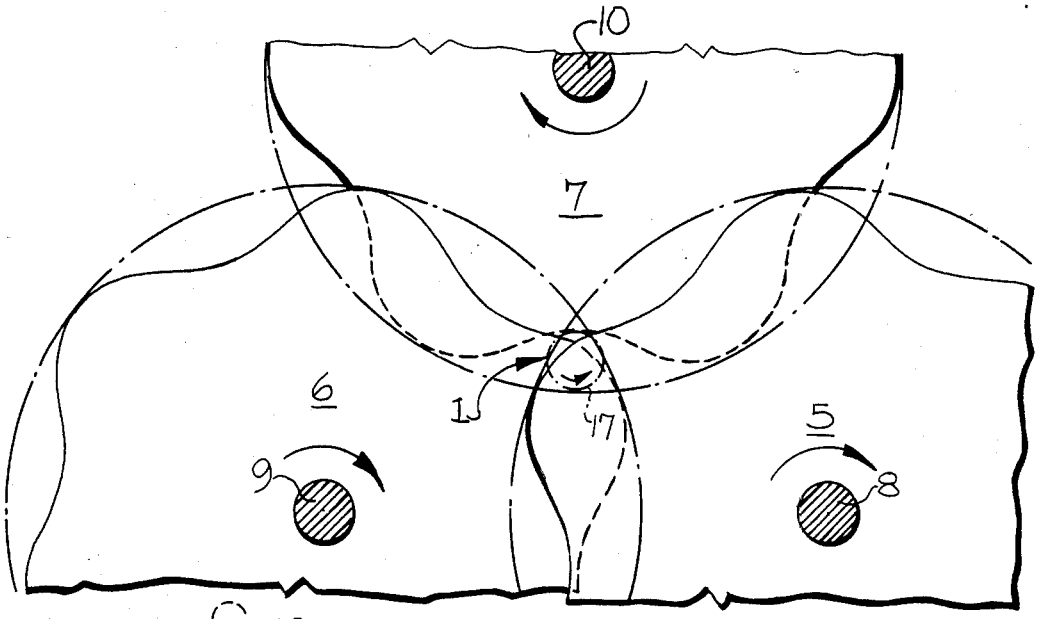
Figure 9A:
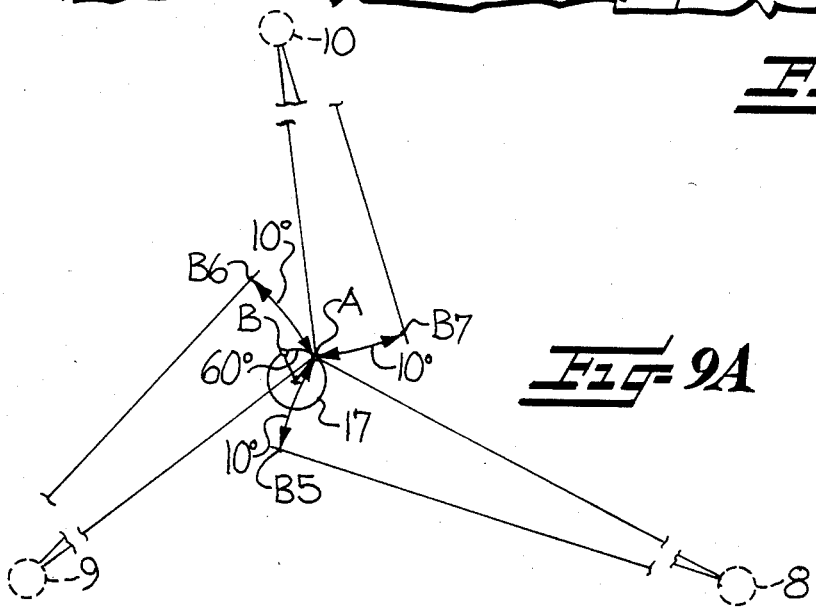

FIGS. 4 and 6 are views similar to FIG. 2, and taken respectively along the line 4—4 of FIG. 3 and 6—6 of FIG. 5;

FIG. 7 is a side elevation view of the twisting operation shown in FIG. 1, but illustrating the use of nip rolls for limiting the upstream extent of the false twist produced by the twisting apparatus;

FIG. 8 is a fragmentary end view of one embodiment of the yarn deflecting discs, and taken in a plane lying transverse to the axes of the discs and the yarn advancing direction;

FIG. 8A is a geometric representation illustrating the manner of constructing the circumference of the deflecting discs of FIG. 8;

FIG. 9 is a view similar to FIG. 8, but illustrating a construction which produces ballooning in the opposite direction; and FIG. 9A is a view similar to FIG. 8A, but illustrating the manner of construction of the discs of FIG. 9.

Referring more particularly to the drawings, a method and apparatus is disclosed in FIG. 1 wherein a yarn 1 in sliver form is fed to a drafting system of which only the front rolls 3 are illustrated. A false twist is imparted to the sliver, specifically a S twist in the illustrated embodiment, by the friction false twisting apparatus 4. The sliver thereby receives false twist in the area between the front rolls 3 and the false twist apparatus 4, and in accordance with the false twist principle, the sliver leaves the false twist apparatus essentially untwisted.

Yarn deflecting means is disposed along the path of travel of the advancing yarn for substantially continuously deflecting the yarn in a direction transverse to its advancing direction. The deflecting means is positioned between the rolls 3 and the friction false twisting apparatus 4, and causes the yarn to assume a ballooning circular movement 11 at an adjacent location. In the illustrated embodiment, the deflecting means comprises three discs 5, 6, and 7, which rotate about the respective axes of shafts 8, 9, and 10, in the same clockwise direction. However, it will be understood that the following description will similarly apply when the discs are all driven counterclockwise. Further, the discs are serially located along the path of travel of the advancing yarn 1, and the peripheries of the discs overlap each other when projected on a plane parallel to the discs and perpendicular to the axes of rotation, and so that the peripheries collectively define a yarn guide passage between the discs and through which the yarn is guided. The periphery of each is non circular, and in particular, is arcuately curved as to impart a substantially continuous movement to the advancing yarn in an enclosed predetermined path when viewed in a transverse plane. By appropriately designing the curvature of the peripheries, the yarn may be brought to a selected path of movement. As illustrated, the yarn is guided by the discs so as to move in a generally circular path when viewed in a transverse plane. It should be noted however, that according to the present invention, it is sufficient that the discs alternately impart an impulse or transverse force to the yarn, without the two other discs simultaneously acting on the yarn. The impulse alternately imparted by the discs and with different rotating directions, causes a rapid vibration of the yarn, which results in ballooning. However, it is preferable that the peripheries of the discs be designed, and with the discs being oriented in phase relationship with each other, so that the discs collectively define a relatively narrow yarn guide passage therethrough.

One preferred construction of the circumference of the discs will now be described with reference to FIGS. 8 and 8A. Initially, it will be assumed that the yarn 1 should rotate clockwise on its circular path in the balloon. Also, referring to FIG. 8A, it will be assumed that the point A represents the present location of the yarn on its orbit in the balloon, and that it is desired to find the radius of the discs 5, 6, and 7 for a selected balloon point B, which is assumed to be 60 degrees from the point A in the given clockwise rotary direction of the balloon. Given a transmission ratio of balloon rotational speed to disc rotational speed of six to one, the discs will rotate 10 degrees while the balloon rotates 60 degrees. Therefore, the circumferential point B5 of disc 5 is determined by describing an arc 10 degrees about the center 8 of the disc 5, starting at point B and moving opposite the given rotary direction of the disc 5. The corresponding circumferential point B6 of disc 6 is found by drawing a 10 degree arc about the center 9 of the disc 6 starting at the point B and moving opposite the given rotary direction of disc 6. The circumferential point B6 is found at the end point of the arc. Similarly, a 10 degree arc drawn from point B about the center 10 of the disc 7, locates the circumferential point B7 of disc 7. It should particularly be noted that the arcs of 10 degrees are respectively drawn opposite the rotary direction of the discs starting from the point B.

Assuming now another selected point C (not shown) on the balloon path 17 in the predetermined rotary direction of the balloon, further circumferential points of the discs 5, 6, and 7 may be found. To obtain a more precise determination of the balloon path, smaller angles of the balloon rotation may be utilized in the above manner. The corresponding angles of the disc rotation will then necessarily be reduced according to the transmission ratio. It should also be noted that the transmission ratio may be predetermined over a wide range, as can the balloon size.

It should also be noted that the discs of FIG. 8, and which are constructed according to the manner of FIG. 8A, can also provide a counterclockwise balloon, without changing the rotary direction of the discs. All that is needed is a phase displacement of the discs, which results in a counterclockwise balloon. It further results from the above construction that the peripheries of all of the discs are congruent. Thus the direction of rotation of the balloon is dictated by the phase displacement of the discs.

The yarn deflecting discs of FIG. 9 have been designed by a construction according to FIG. 9A. FIG. 9 illustrates a design which produces a counterclockwise rotating balloon, with a clockwise rotation of the discs. The construction of FIG. 9A is used in particular when the balloon path 17 is small in relation to the radius, which is usually the case in actual practice. A typical diameter of the discs may for example be 50 mm, while the balloon diameter is 2 mm.

Referring again to FIGS. 9 and 9A, the balloon point A determines the disc radial points A5, A6, and A7. By counterclockwise rotation of 60 degrees in the direction of balloon rotation, a balloon point B may be defined. Circumferential points B5, B6, and B are then found as follows. Starting from point A, a 10 degree arc is drawn about each of the respective disc centers 8, 9, and 10, and the end point of the arcs locate the points B5, B6, and B7. The other circumferential points are found in a similar manner.

It will be appreciated that any balloon path 17 can be produced, for example a polygonal path which is advantageous in that it results in additional dynamic impulse forces.

FIG. 7 illustrates an apparatus generally corresponding to that of FIG. 1, but which further includes twist stop means 18 consisting of two nip rolls, which are pressed against each other by a spring 19. The nip rolls are designed to prevent or at least impede the twist from extending upstream to the yarn deflecting or ballooning discs. The rolls also tend to promote the effect of the balloon, i.e., the loosening of individual fibers from the surface of the drawn yarn.

In the embodiment of FIG. 1, the friction false twist apparatus 4 comprises two discs 12 and 13, with each disc including a yarn engaging friction surface, and with at least the disc 13 being relatively thin and flexible. The discs are rotatably mounted such that the respective yarn engaging friction surfaces are disposed in an opposing face to face relationship and define a twisting zone therebetween through which the advancing yarn passes. Suitable drive means (not shown) is provided for operatively rotating each of the discs about their respective axes. In addition a resilient contact presuure means 14 is operatively positioned adjacent the back side of the flexible disc 13 for applying a force to effect local biasing of such disc toward the disc 12 at the twisting zone. The disc 12 preferably is substantially rigid to resist the biasing force, so that the yarn is nipped therebetween. Also, as will be apparent, the rotating discs serve to impart a transverse twisting force component to the advancing yarn, as well as a force component in the advancing direction. A twisting unit of this type is further described in German OS Nos. 29 28 522; 31 23 670; and 30 23 887, and corresponding U.S. Pat. Nos. 4,339,915; 4,383,405; and 4,408,449, the disclosures of which are expressly incorporated herein by reference.

FIGS. 3 and 4 illustrate a further embodiment of the twisting apparatus, which also comprises a pair of twist imparting circular discs 12 and 13. In this embodiment however, the flexible disc 13 is mounted for rotation about an axis which is somewhat canted with respect to the axis of the disc 12, and so that the disc 13 is laterally deflected from its normal running plane by its contact with the advancing yarn or the disc 12.

FIGS. 5 and 6 illustrate still another embodiment of the twisting apparatus, and wherein the twist imparting members comprise a pair of endless belts 20, 21 which are mounted for rotation on suitable pulleys 22 so that the outer faces of the belts cross each other at the twisting zone. Also, a pressure applying member 23 is mounted adjacent the inner face of each belt at the twisting zone, so as to bias the two belts toward each other in alignment with the twisting zone. A pressure applying member of this type is further described in U.S. Pat. No. 4,377,932.

According to the present invention, three false twist imparting forces are developed. The primary false twist is produced by the friction false twist apparatus 4. Another false twist is produced by reason of the yarn being brought into a ballooning motion, and finally, a false twist is produced by reason of the contact of the yarn with the peripheries of the rotating discs 5, 6, and 7. All of these twists may be of the same direction. However, it is preferred that the twist effects created by the balloon and by the peripheral contact with the discs 5, 6, and 7 are of the same direction, but opposite to the direction of the twist imparted by the friction false twist apparatus 4. This results in that the twist in the balloon area is at least partially opened, and the dynamic forces generated in the balloon, in particular the centrifugal forces, are all the more able to cause the fiber ends to loosen and separate from the surface of the advancing yarn. These individual fiber ends 16 are, upon leaving the friction false twist apparatus 4, caused to be wrapped about the substantially untwisted yarn body 15, since they have not, or only partially, received the twist existing upstream of the friction false twist apparatus.

To further describe the manner in which the loose individual fibers are wrapped about the yarn, it should initially be understood that the discs 12 and 13 exert only a false twisting action, and thus the fibers which have been wrapped by the false twisting action will leave the discs without being wrapped. However, there will be additional loose fibers which are not wrapped by the false twisting action because they are separated from the body of the yarn. These loose fibers remain generally parallel to each other in the area immediately upstream of the discs 12 and 13. Upon passing through these discs, the yarn rotates in the opposite or untwisting direction, to the effect that the false twisted fibers are untwisted, but with the non-twisted fibers being gripped by the discs at the moment the yarn rotates in the opposite direction. Thus these loose non-twisted fibers will receive a twist and will be wrapped about the yarn. The upstream ballooning of the yarn serves to increase and control the number or these loose fibers.

In the drawings and specification, there has been set forth preferred embodiments of the invention, and although specific terms are employed, they are used in a generic and descriptive sense only and not for purposes of limitation.

That which is claimed is:

1. A method for producing a spun yarn comprising the steps of advancing a yarn which includes staple fibers along a path of travel, deflecting the advancing yarn by physically contacting the yarn with a moving guide member so as to oscillate the advancing yarn in two dimensions transverse to its advancing direction, and so as to cause fibers to be loosened on the surface of the yarn, and then wrapping the loosened fibers spirally about the body of the advancing yarn.

2. The method as defined in claim 1 wherein the moving guide member includes the periphery of at least one rotating disc.

3. The method as defined in claim 1 wherein the moving guide member includes the periphery of each of a plurality of rotating, noncircular discs.

4. The method as defined in claim 3 wherein the noncircular discs deflect the advancing yarn in a generally circular path when viewed in a transverse plane, and so as to produce a ballooning circular movement in the advancing yarn at an adjacent location.

5. The method as defined in claim 4 wherein the ballooning circular movement is opposite to the direction in which the loosened fibers are wrapped about the advancing yarn.

6. The method as defined in claim 4 wherein the ballooning circular movement is in the same direction in which the loosened fibers are wrapped about the advancing yarn.

7. The method as defined in claim 1 wherein the step of wrapping the loosened fibers about the advancing yarn includes frictionally contacting opposite sides of the advancing yarn so as to impart a transverse twisting force component as well as a force component in the advancing direction.

8. The method as defined in claim 7 wherein the step of frictionally contacting opposite sides of the advancing yarn includes passing the running yarn between opposed oppositely moving twisting members having opposed friction surfaces, with at least one of the members being relatively thin and flexible, and while locally biasing such one flexible member toward the other member at a location overlying the advancing yarn so as to frictionally engage the advancing yarn between the moving friction surfaces.

9. The method as defined in claim 8 wherein the twisting members are circular discs.

10. A method for producing a spun yarn comprising the steps of advancing a yarn composed of substantially untwisted staple fibers along a path of travel, flase twisting the advancing yarn at a twisting location along its path of travel and so that false twists are formed in the yarn upstream of the twisting location, deflecting the advancing yarn at a location upstream of the twisting location, with the deflecting step including physically contacting the advancing yarn with a moving guide member so as to substantially continuously laterally oscillate the advancing yarn in two dimensions and cause fibers to be loosened on the surface of the yarn, and whereby the loosened fibers are spirally wrapped about the body of the advancing yarn upon passing through said twisting location.

11. The method as defined in claim 10 wherein the deflecting step includes serially contacting the yarn with the periphery of a plurality of rotating, non-circular discs so as to laterally deflect the advancing yarn in a generally circular path when viewed in a transverse plane, and so as to produce a ballooning circular movement in the advancing yarn at an adjacent location.

12. The method as defined in claim 11 wherein the rotational direction of said discs and the rotational direction of said ballooning circular movement are opposite to the direction of the false twists formed upstream of the twisting location.

13. The method as defined in claim 12 wherein the false twists extend to the location at which the deflecting step is carried out.

14. The method as defined in claim 11 comprising the further step of passing the advancing yarn between a pair of nip rolls intermediate the deflecting location and the twisting location, and so as to limit the extent of the false twists.

15. The method as defined in claim 11 wherein said twisting step includes frictionally contacting opposite sides of the advancing yarn so as to impart a transverse twisting force component as well as a force component in the advancing direction.

16. An apparatus for producing a spun yarn comprising means for advancing a yarn along a path of travel, deflecting means including a moving guide member disposed along said path of travel for physically contacting the advancing yarn so as to oscillate the advancing yarn in two dimensions transverse to its advancing direction so as to cause fibers to be loosened on the surface of the yarn, and twisting means disposed along said path of travel and downstream of said deflecting means for wrapping the loosened fibers spirally about the body of the advancing yarn.

17. The apparatus as defined in claim 16 wherein said deflecting means includes at least one rotating disc mounted so that its periphery physically contacts the running yarn.

18. The apparatus as defined in claim 16 wherein said deflecting means comprises a plurality of non-circular discs, with said discs being mounted for rotation about parallel axes, and further comprising means for rotating said discs in a common direction and at a uniform rotational speed.

19. The apparatus as defined in claim 18 wherein said deflecting means comprises three of said discs, with the axes of said discs being disposed at the corners of an equilateral triangle and with said discs being located to serially contact the advancing yarn.

20. The apparatus as defined in claim 19 wherein the peripheries of said rotating discs are arcuately curved so that upon rotation of the discs, the peripheries collectively define a yarn guide passage which moves along a generally circular path when viewed in a plane transverse to the direction of the advancing yarn.

21. An apparatus for producing a spun yarn comprising means for advancing a yarn along a path of travel, deflecting means disposed along said path of travel for substantially continuously oscillating the advancing yarn in two dimensions transverse to its advancing direction, and including a plurality of rotating discs disposed for rotation about separate axes which are generally parallel to the advancing direction, and with said discs being located so that the peripheries thereof serially physically contact the advancing yarn and so that said discs collectively impart substantially continuous movement to the advancing yarn so as to cause fibers to be loosened on the surface of the advancing yarn, and twisting means disposed along said path of travel downstream of said deflecting means for imparting false twists to the yarn which extend upstream of said twisting means, and such that the loosened fibers are spirally wrapped about the body of the advancing yarn upon passing therethrough.

22. The apparatus as defined in claim 21 wherein said deflecting means comprises three of said discs which are disposed with the axes thereof located at the corners of an equilateral triangle, means rotatably driving said discs at the same rotational speed and in a predetermined angular relationship, and wherein the peripheries of said discs are arcuately curved so as to collectively define a yarn guide passage which, during rotation, moves along a generally circular path when viewed in a plane transverse to the advancing direction.

23. The apparatus as defined in claim 22 wherein said twisting means comprises a pair of twist imparting members, with each member including a yarn engaging friction surface, and at least one of said members being relatively thin and flexible, means rotatably mounting said twist imparting members such that portions of the respective yarn engaging friction surfaces are disposed in opposing, face to face relationship and define a twisting zone therebetween through which said advancing yarn is adapted to pass, and drive means for operatively rotating each of said twist imparting members about their respective axes.

24. The apparatus as defined in claim 23 further comprising biasing means operatively positioned with respect to said twist imparting members for applying a force to effect biasing of said twist imparting members toward each other locally at said twisting zone.

25. The apparatus as defined in claim 24 wherein each of said twist imparting members comprises a circular disc, with said twist imparting discs being mounted for rotation about substantially parallel axes, and with one of said twist imparting discs being relatively thin and flexible and the other twist imparting disc being substantially rigid.

26. The apparatus as defined in claim 25 wherein said biasing means comprises disc impingement means mounted adjacent the face of said flexible twist imparting disc opposite its yarn engaging friction surface and aligned with said twisting zone.

27. The apparatus as defined in claim 24 wherein at least one of said twist imparting members comprises an endless belt, and wherein said biasing means comprises a pressure applying member positioned to act upon the inner face of said belt in alignment with said twisting zone.

28. The apparatus as defined in claim 23 wherein at least one of said twist imparting members comprises a relatively thin and flexible circular disc, and wherein said disc is mounted so that a portion thereof is adapted to be laterally deflected from its normal running plane by its contact with the advancing yarn or the other twist imparting member.

29. The apparatus as defined in claim 21 further comprising nip roll means disposed along said path of travel and between said deflecting means and said twisting means for engaging the advancing yarn so as to prevent the false twists produced in the yarn by said twisting means from reaching the location of said deflecting means.

* * * * *